United States Patent [19]

Peter-Hoblyn et al.

[11] Patent Number: 4,776,289

[45] Date of Patent: Oct. 11, 1988

[54] METHOD AND APPARATUS FOR BURNING PULVERIZED SOLID FUEL

[75] Inventors: Jeremy Peter-Hoblyn, Cornwall, England; Normand A. Brais, Prevost; Francois X. Grimard, St. Therese, both of Canada

[73] Assignee: Fuel Tech, Inc., Stamford, Conn.

[21] Appl. No.: 63,536

[22] Filed: Jun. 18, 1987

[51] Int. Cl.[4] ..... F23D 1/00

[52] U.S. Cl. ..... 110/347; 110/264

[58] Field of Search ..... 110/264, 265, 347; 431/284

[56] References Cited

U.S. PATENT DOCUMENTS

| | | | |
|---|---|---|---|
| 4,223,615 | 9/1980 | Breen et al. | 110/264 |
| 4,243,375 | 1/1981 | Reed | 431/284 X |
| 4,252,069 | 2/1981 | McCartney | 110/265 X |
| 4,260,364 | 4/1981 | Young et al. | 110/265 X |
| 4,303,386 | 12/1981 | Voorheis et al. | 431/284 X |

*Primary Examiner*—Edward G. Favors

*Attorney, Agent, or Firm*—St. Onge Steward Johnston & Reens

[57] ABSTRACT

A process and apparatus are described with which pulverized coal can be burned with an essentially non-turbulent flame in which the residence time of individual cool particles within the burner flame is generally increased. Pulverized cool is supplied through a plurality of annularly-distributed conduits. A supply of secondary air is passed around the conduits in a manner so as to produce an axial or low turbulent flow of air from the burner with a relatively small amount of the combustion air being swirled to produce a vortex suitable to anchor the burner flame. The pulverized solid fuel is injected to enter both the vortex and flame regions so as to expose a large portion of fuel particles to a low turbulent diffusion flame in which oxygen reaches burning particles primarily by way of a diffusion process.

9 Claims, 4 Drawing Sheets

METHOD AND APPARATUS FOR BURNING PULVERIZED SOLID FUEL

FIELD OF THE INVENTION

This invention relates to a method and apparatus for burning solid fuel such as pulverized coal.

BACKGROUND OF THE INVENTION

Pulverized coal burners are well known. For example, U.S. Pat. No. 4,147,116 describes a swirl burner in which pulverized coal is delivered with a spiraling motion to centrifugally concentrate at the perimeter of a central tube. The pulverized coal is then diffused into a conical pattern by a vaned diffuser located at the discharge end of the central tube. This type of burner is essentially a swirl burner with which a large bulky flame is produced whose shape and travel may be somewhat controlled by adjusting the position of a deflector.

U.S. Pat. No. 4,434,727 describes a pulverized coal burner wherein combustion air surrounds a central coal delivery tube whose discharge end is shaped to widely disperse the fuel. The nozzle presents a significant blockage to the fuel flow, thus causing a significant pressure drop and load on the forced draft fan. This burner also tends to create a central region of low oxygen content that is difficult to ignite.

U.S. Pat. No. 4,422,389 illustrates a pulverized coal burner wherein the pulverized coal fuel is delivered through an annular conduit that surrounds a central conduit through which combustion air is supplied. U.S. Pat. No. 4,350,103 describes a solid fuel burner in which a central stream of pulverized coal is passed through a premix chamber and is shrouded by a secondary gas stream.

A swirl-type burner for solid fuel formed of pulverized coal is shown in U.S. Pat. No. 4,515,090. This burner produces a turbulent flame intended to enhance the mixing of primary and secondary air with the pulverized fuel. Another swirl type pulverized coal burner is shown in U.S. Pat. No. 4,457,241.

In an electric utility station, an array of burners is commonly used to provide the required boiler heat. It is often necessary to vary the heat output from the array of burners to match partial electrical loads. This can be done in part by reducing, i.e., turning-down, the amount of heat produced by each burner. Such turn-down can be obtained by reducing the combustion air and fuel through the burner. When the turn-down ratio, however, becomes too high, the swirl effect tends to reduce to a level where combustion may not be sustained or the flame temperature changes so as to increase pollutant problems such as excessive production of $SO_3$. Hence, in practice, when substantial heat reduction is required, individual burner turn-down is but partially relied upon and selected burners in the array are actually shut-down. Such complete turn-off of burners, however, affects the temperature profile of the array and may create undesirable cold spots.

The swirl type solid fuel burners produce a large bulky flame that is stabilized in a region in front of the burner by the swirling motion. The swirl burners produce strong turbulent flames whose interactions with each other in an array is difficult to control and predict so that interference between the flames can be detrimental. The use of a strongly turbulent high fuel velocity swirling burner results in high coal particles velocities relative to air to promote combustion. It is very difficult to model the airflow to achieve uniform distribution of combustion air in a multiburner or array type installation.

Such high coal particle velocities is generally recommended to promote the supply of oxygen to burning coal particles and thus reduce the effect from a normally slower process whereby oxygen diffuses to the shrinking burning particle. See for example, articles entitled "Burning Characteristics of Pulverized Coal" by A. B. Hedley and M. E. Leesley, published during 1965 in the *Journal of the Institute of Fuels;* "Conditions For The Stable Burning Of Carbon In An Airstream" by D. B. Spalding at pages 288–295 of the *Journal of the Institute of Fuels* published Dec., 1953; and "Combustion Of Millimeter Sized Coal Particles In Convection Flow" by K. W. Ragland and J. T. Yong published in *Combustion And Flame* at pages 285–297 in 1985.

Natural gas burners are known, such as the DYNASWIRL venturi register gas burner, manufactured and sold by the assignee of this invention, and with which an elongated flame is produced with both an axial gasflow and a vortex to stabilize the flame. The gaseous fuel is supplied through a plurality of tubes whose end faces are oriented to direct the fuel through specially drilled injector faces towards the primary air flow stream. The tubes are also tangentially oriented.

SUMMARY OF THE INVENTION

In a method and apparatus in accordance with the invention, pulverized coal is burned under conditions of low turbulence but high axial flow to provide satisfactory combustion throughout a wide range of burner turn-down ratios.

This is achieved in accordance with one technique in accordance with the invention by directing fluidized, pulverized coal and combustion gas from a burner so as to produce an axial flow of coal and gas with an elongated flame. Ignited coal particles are subjected to less turbulence and, on the average, spend a significantly longer time within the elongated flame to assure combustion. Some of the mass flow from the burner is forced into a spiral motion so as to provide sufficient anchoring of the flame to a region in front of the burner.

With such technique for supplying pulverized coal and combustion gas, high turn-down ratios can be obtained while preserving desired fuel burning and flame characteristics. Acceptable performance can be obtained with turn-down ratios up to as much as five to one relative to full power output, thus advantageously eliminating the need to fully shut-down selected burners in an array. The operation of an array can be more accurately regulated to obtain a desired heat distribution since interactions by adjacent flames is reduced.

A lower $NO_x$ combustion may be achieved by controlling peak flame temperatures in individual burners through the regulation of the mixing of air and fuel in the high temperature areas and/or the operation of burners in an array in a sub-stoichiometric, i.e., in a fuel rich, manner.

As described herein for one embodiment in accordance with the invention, pulverized coal is supplied through a plurality of annularly-distributed individual fuel supply tubes which terminate with open unobstructed ends. The ends are oriented to direct pulverized coal towards the central air flow stream in front of the burner and with a tangential orientation to assure a proper distribution of fuel. The fuel supply tubes are removable from the backside of the burner for replacement. In the operation of the burner, pulverized coal is projected in a longitudinal direction to provide an elongated flame wherein the coal particles burn-off occurs primarily by way of diffusion of oxygen to the particles and increased residence time of the particles in the flame.

With a burner in accordance with the invention modelling of the pulverized coal operation is much improved in that the mean mass flow and even air distribution can be more precisely predicted. This in turn facilitates control over thermal $NO_x$.

It is, therefore, an object of the invention to provide a method and burner for pulverized fuel such as coal with a high turn-down ratio capability. It is a further object of the invention to provide such method and burner while providing a high degree of regulation over the flame.

These and other advantages and objects of the invention can be understood from the following detailed description of an embodiment described in conjunction with the drawings.

DETAILED DESCRIPTION OF DRAWINGS

Figure 1:
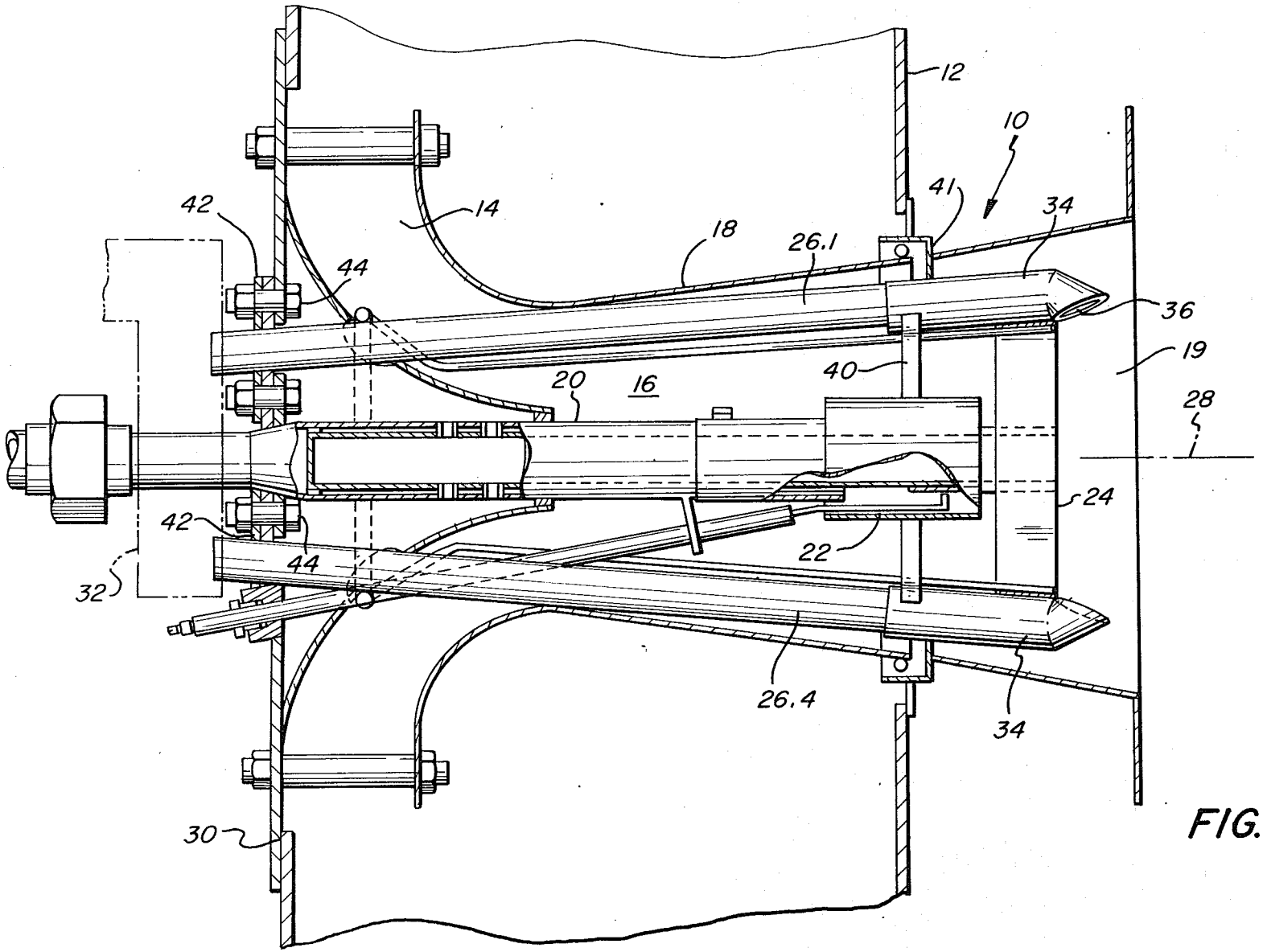
FIG. 1 is vertical sectional view of a solid fuel burner in accordance with the invention.
Figure 2:
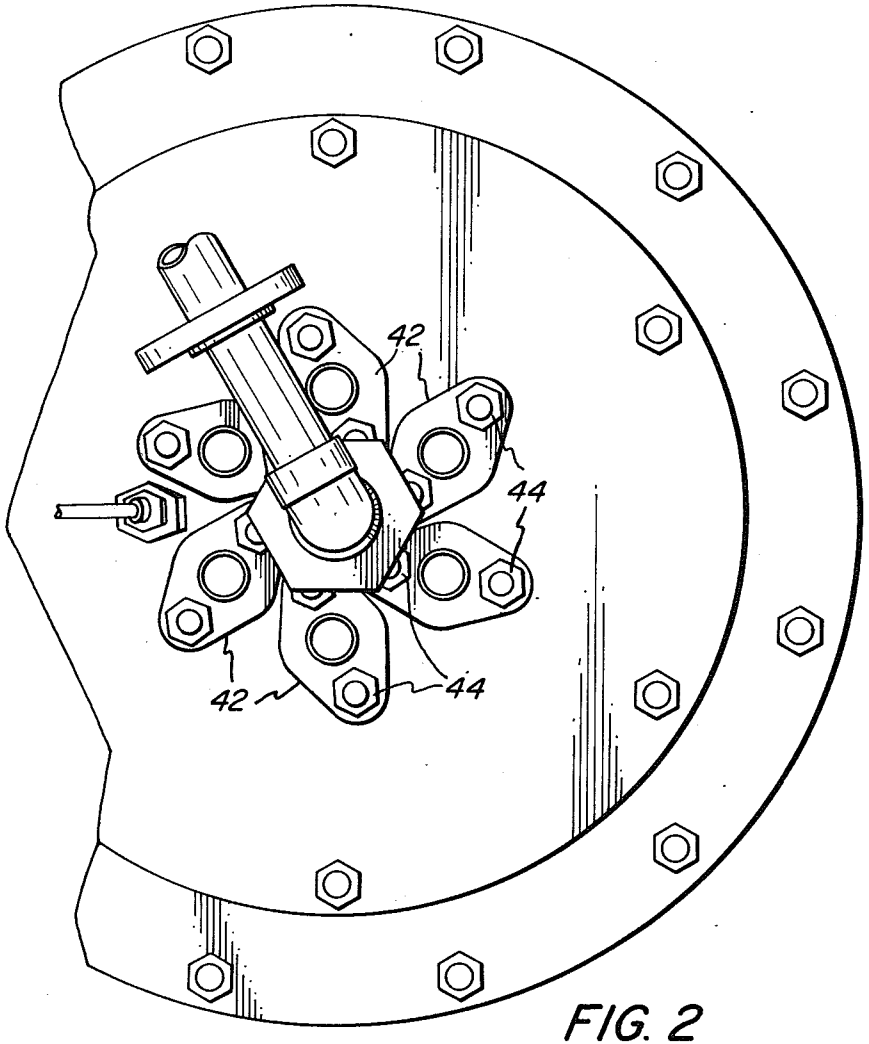
FIG. 2 is a rear view in elevation of the burner of FIG. 1.
Figure 3:
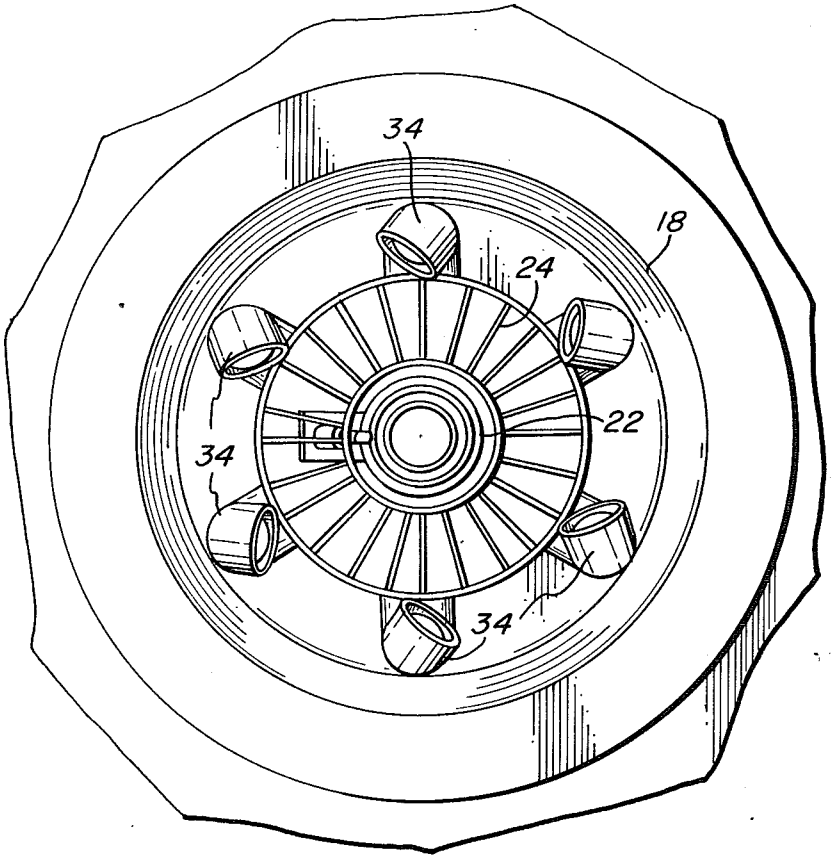
FIG. 3 is a front view in elevation of the burner of FIG. 2.

With reference to FIGS. 1, 2 and 3, a small capacity burner 10, similar to some extent as the aforementioned DYNASWIRL burner but modified in accordance with the invention, is shown mounted to a windbox 12. Secondary combustion air is supplied from the windbox 12 through an annular conduit 14 that is in communication with a chamber 16 that is bounded by a conicallyshaped expanding wall 18 and terminates at throat end 19.

A central conduit 20 provides a supply of ignition fuel that is ignited with an appropriate igniter device 22 located near the throat end 18. Conduit 20 can also provide gas or oil fuel as that may be needed to supplement the pulverized coal fuel. A diffuser 24 is located around device 22 in the path of combustion air. Diffuser 24 is shaped so as to impart a swirl action to a limited amount of the combustion air, but sufficient to anchor a subsequent flame to a region located in front of the burner 10.

Within chamber 16 are a plurality of conduits 26 in the form of solid fuel delivery tubes which are inclined outwardly relative to the central axis 28 of burner 10 and are annularly-distributed about axis 28. This outward inclination is likely to be reduced to where tubes 26 are parallel to the burner axis 28 in a large scale model. Tubes 26 extend through the rear wall 30 of windbox 12 and terminate at a header 32 from which pulverized coal is supplied in a fluidized form with a primary air carrier. Techniques for supplying pulverized coal are well known in the art and, therefore, need not be further explained.

Figure 4:
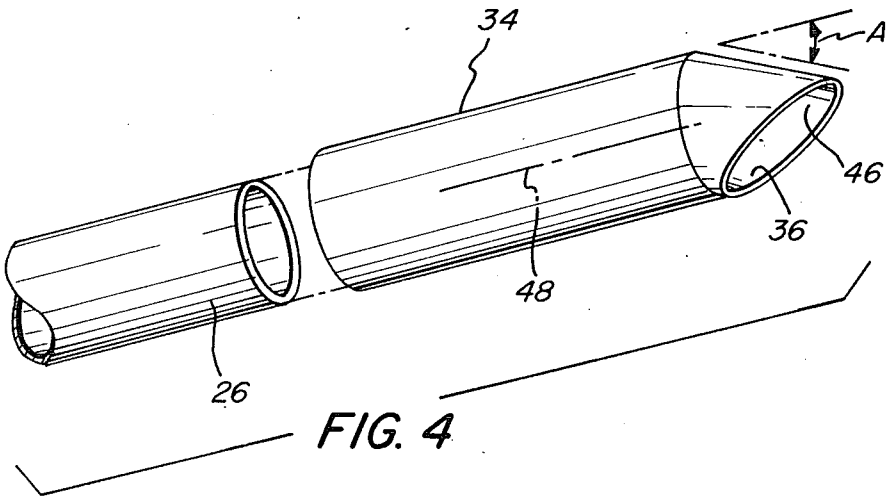
FIG. 4 is a side view of a fuel supply tube used to supply solid fuel in the burner of FIG. 1.
Figure 7:
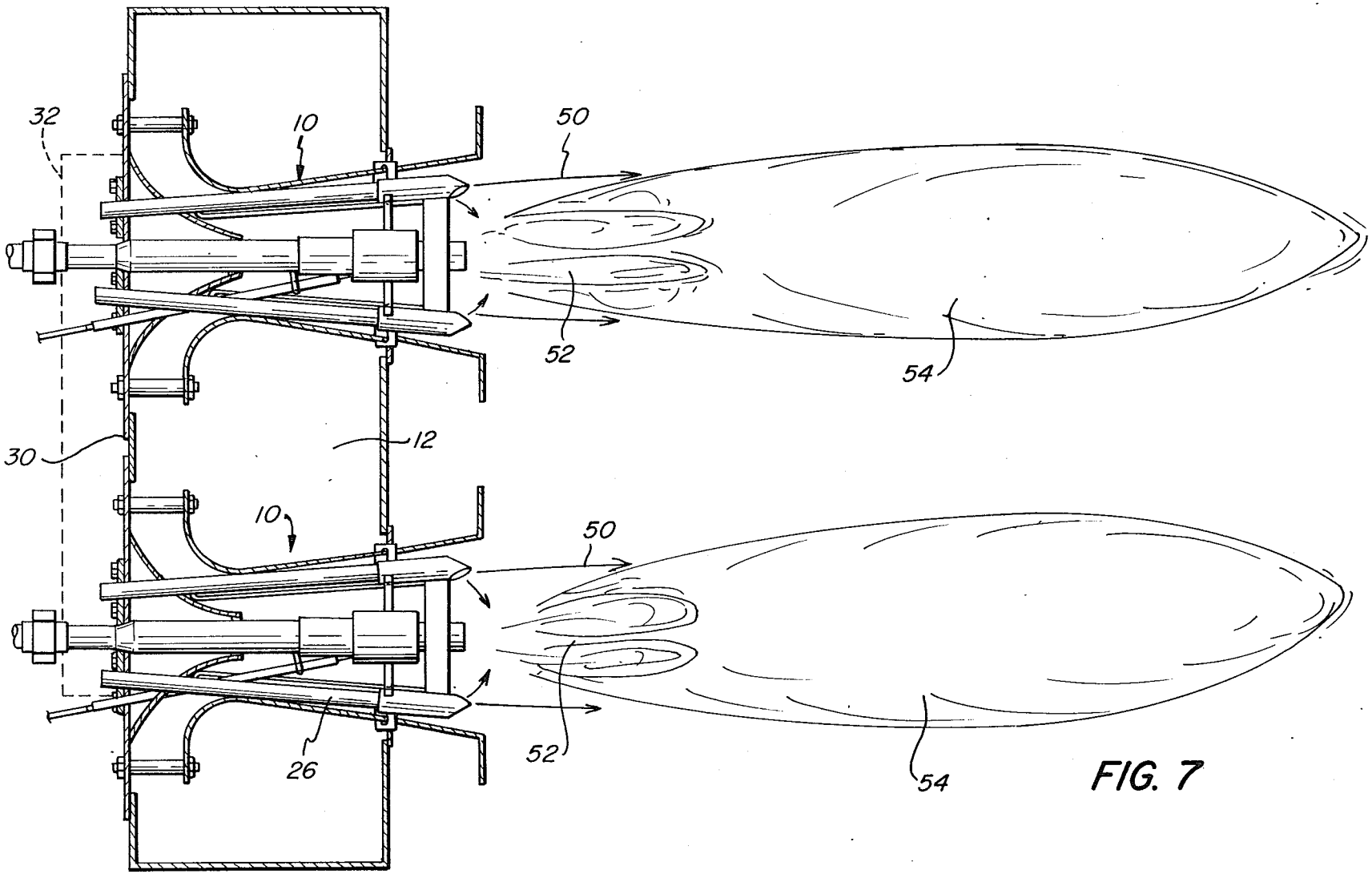
FIG. 7 is a partial side view in elevation of the installation and operation of a pair of burners in accordance with the invention.

Tubes 26 are provided with removable deflection ends 34 which terminate with unrestricted openings 36 at ends 38. The tubes 26 are removably mounted in chamber 16 with support brackets 40 and 41 near diffuser 24 and removable support clamps 42 at windbox wall 30. Clamps 42 are in turn affixed to wall 30 with suitable bolts 44. FIG. 4 shows an enlarged view of a fuel tube end 34 which has a deflection wall 46 at a solid angle A relative to the longitudinal axis 48 of tube 26. The angle A as shown in FIG. 4 is the angle that lies in a plane that contains both the burner axis 28 and tube axis 48. Angle A is selected so that solid fuel is discharged as shown in FIG. 7 primarily in a longitudinal direction 50 with significant portions being directed at the vortex region 52 of flame 54. Attachments of removable end section 34, which has a greater diameter, can be done with suitable collars and other metal-fastening devices.

With the deflection wall 46 in tube ends 34, the flow of an abrasive solid fuel such as pulverized coal will eventually cause extensive war. Hence, the removable mounting of the solid fuel tubes 26 advantageously enables replacement of the tube ends 34 or the entire tube 26.

Figure 5:
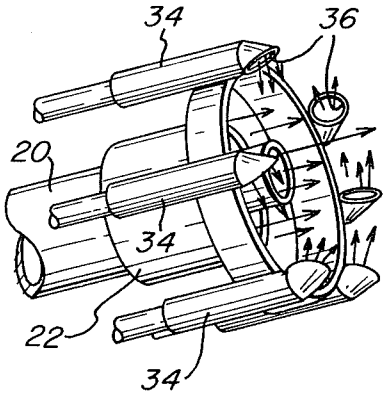
FIG. 5 is a partial perspective view of the burner of FIG. 1.

As illustrated in the views of FIGS. 3 and 5, the fuel supply tubes 26 are evenly distributed about the burner axis 28 and are rotated about their longitudinal axes 48. This orients the end openings 36 of tubes 26 towards a tangential direction to control the mixture fraction in the vortex zone 52 created by the effect from diffuser 24.

As shown in FIG. 7, burner 10 generates a flame 54 in which the gas flow occurs with relatively little turbulence and primarily with an axial flow pattern. This results in an elongated flame 54 in which the residence time of individual coal particles is significantly increased. Some swirling effect from diffuser 24 is needed, but only that amount required to anchor the base of flame 50 in front of burner 10. Although the amount of the combustion air that is subjected to swirling can be varied, preferably less than about twenty percent (20%), or approximately from about ten percent (10%) to about twenty-five percent (25%) of the total air delivered to the flame region is swirled. The balance of the air flow is primarily in an axial direction, parallel to the burner axis 28 and is axial. As a result of the increased residence time of the coal particles within the flame, the relative velocity between coal particles and air is reduced and oxygen diffusion processes predominate in the burning of the particles.

In the burner, the primary air that is supplied with the pulverized coal from fuel tubes 26 represents about ten percent (10%) of the stoichiometric combustion air. Generally, the total amount of primary air can be varied but preferably it is in the range of about ten percent (10%) to about twenty-five percent (25%) of the total combustion air so that secondary air that is supplied though the annular inlet 14 and around the fuel supply tubes 26 is the dominant air flow. This secondary air is introduced with an even velocity profile so as to produce the desired axial air flow outside burner 10.

With a solid fuel-type burner in accordance with the invention, the turn-down of the burner can be to a level that extends to about one-fifth of the full load operation of the burner while still preserving the integrity of the flame. Such turn-down can be implemented by the use of stable well-known dampers located in the windbox 12 and with control over the supply of pulverized coal through fuel tubes 26. Turn-down is generally limited so to preserve a minimum air velocity through the burner for its proper operation.

Figure 6:
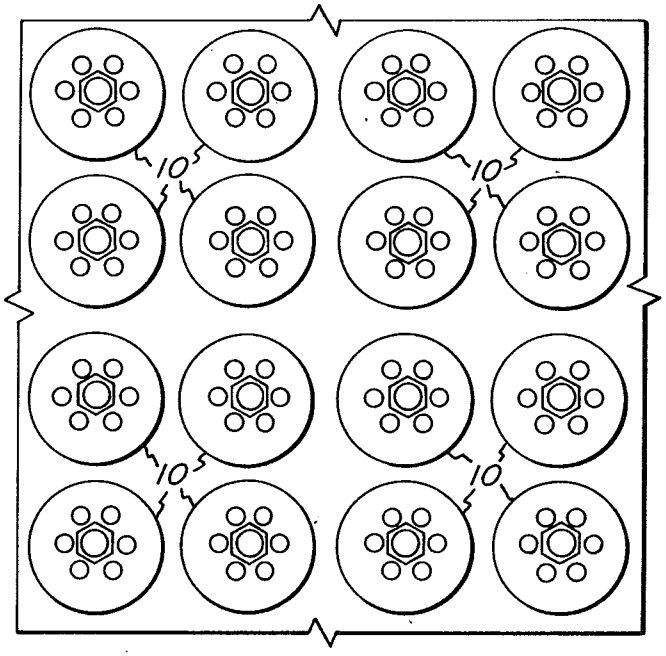
FIG. 6 is a front view in elevation of an array of burners of FIG. 1 in accordance with the invention.

Hence, burners such as 10 can be advantageously used in a closely-spaced array 60 as shown in FIG. 6 and for several solid fuel burners 10 in FIG. 7 while minimizing unpredictable operations and interactions between the flames as would be encountered with conventional solid fuel strong swirl-type burners. A more even air distribution around the flames can be achieved.

Having thus described one illustrative technique in accordance with the invention, its advantageous can be appreciated. Variations from the embodiment can be made without departing from the scope of the invention. For example, the pulverized solid fuel can be delivered through the conduits in the form of a coal slurry (using about 30 percent water) or with a flue gas carrier or in a phase without a gas or water carrier.

What is claimed is:

1. A process for burning pulverized solid fuel in the flame of a burner comprising the simultaneous steps of:

supplying combustion air to the discharge end of the burner so as to produce a vortex that is sufficient to stabilize the burner flame in a region in front of the burner;

delivering a pulverized solid fuel, formed of particles, to a discharge end of the burner through a plurality of separate conduits that are distributed around the combustion air vortex;

passing combustion air around the solid fuel delivering conduits to establish an axial gas flow from the burner along the flame region; and discharging the pulverized solid fuel from the conduits in a direction as will inject the particles into the axial flow part of the flame region as well as into the vortex to establish a pulverized solid-fuelfed elongated flame with enhanced particle residence time.

2. The burning process as claimed in claim 1 wherein the vortex producing step further comprises:

directing an amount of combustion air through a vortex generator where the amount is generally less than about twenty-five percent (25%) of the total amount of combustion air delivered to the flame region.

3. The burning process as claimed in claim 2 wherein the step of discharging the pulverized solid fuel includes:

deflecting solid fuel delivered through the conduits toward the flame region in a solid angle that includes the vortex of the flame.

4. The burning process as claimed in claim 3 and further including reducing the amount of combustion air and pulverized solid fuel in a range that extends to about one-fifth of full load operation while preserving the integrity of the flame.

5. The burning process as claimed in claim 1 wherein the solid fuel is delivered through the conduits with a carrier of primary air and where the amount of primary air through the conduits is generally in the range from about ten percent (10%) to about twenty-five percent (25%) of the total amount of combustion air delivered to the flame region.

6. In a burner for the burning of pulverized solid fuel in an axial flow burner wherein a plurality of fuel conduits are arranged around a vortex generating section and are located inside a combustion air chamber from which air is projected to produce an axial flow in a flame region that is anchored to a stable location by a vortex produced by the vortex generating section, the improvement comprising:

means for removably-mounting the fuel conduits inside the burner, said fuel conduits terminating at open discharge ends having deflecting walls oriented to discharge pulverized solid fuel at the vortex.

7. The improved pulverized solid fuel burner as claimed in claim 6 wherein the solid fuel conduits have removable end sections.

8. The improved pulverized solid fuel burner as claimed in claim 6 wherein the solid fuel conduits end sections have unobstructed discharge openings.

9. The improved pulverized solid fuel burner as claimed in claim 8 wherein the solid fuel conduits are tubular.

* * * * *